US005244021A

United States Patent [19]

Hau

[11] Patent Number: 5,244,021

[45] Date of Patent: Sep. 14, 1993

[54] FUEL TRANSFER CONTAINER

[76] Inventor: Ernest F. Hau, 71 Whitney St., Closter, N.J. 07624

[21] Appl. No.: 806,472

[22] Filed: Dec. 13, 1991

[51] Int. Cl.[5] ..... B65B 1/04; B65B 3/04

[52] U.S. Cl. ..... 141/285; 141/29; 141/290; 141/309; 222/530; 222/188; 222/633; 169/54

[58] Field of Search ..... 141/29, 247, 285, 301, 141/309, 291, 292, 25, 26, 290, 391, 392; 222/209, 530, 527, 401, 95, 192, 188, 633, 211; 169/54

[56] References Cited

U.S. PATENT DOCUMENTS

| | | | |
|---|---|---|---|
| 2,684,787 | 7/1954 | Charpiat | 222/530 |
| 2,709,542 | 5/1955 | Eller et al. | 222/209 |
| 3,010,614 | 11/1961 | Udy | 222/209 |
| 3,109,563 | 11/1963 | Morales | 222/192 |
| 4,901,878 | 2/1990 | Humphries | 222/530 |

*Primary Examiner*—Henry J. Recla
*Assistant Examiner*—Steven O. Douglas
*Attorney, Agent, or Firm*—Leon Gilden

[57] ABSTRACT

A container includes a fill cap, with a delivery conduit directed exteriorly of the fill cap, with a lower distal end within the container adjacent a floor of the container. The delivery conduit is arranged to include a delivery tube end member that includes a forward portion with a collar thereabout, including an outer conduit adjacent an inner central conduit, and the outer conduit is vented rearwardly of the collar for venting of fumes within a delivery fuel tank. A pressurizing squeeze bulb is in pneumatic communication interiorly of the container to effect pressurizing of fuel and fluid contained therewithin for direction through the delivery conduit, wherein the delivery conduit may further include a shut-off valve to cease fuel flow therethrough.

1 Claim, 5 Drawing Sheets

FUEL TRANSFER CONTAINER

BACKGROUND OF THE INVENTION

1. Field of the Invention

The field of invention relates to fuel transfer container apparatus, and more particularly pertains to a new and improved fuel transfer container wherein the same is arranged for the ease of delivery of fuel from a first container to a fuel tank.

2. Description of the Prior Art

Transfer of fuel from a storage container to a fuel tank is typically associated with a degree of risk relative to such fuel transfer. The conventional transfer of such fuel is typically utilized in a manner to merely direct by gravity flow fuel from a storage container to an associated fuel tank. While the prior art in various fluid delivery systems permits the pressure directing of fluid flow, the unique organization of the instant invention has heretofore not been specifically adjusted for the prior art in the directing of fuel from a storage container to a receiving tank or receptacle. Examples of prior art dispensing nozzles and the like are available in the U.S. Pat. No. 4,878,604 to Barriac; U.S. Pat. No. 4,667,856 to Nelson; U.S. Pat. No. 4,846,308 to Sui; and U.S. Pat. No. 4,909,416 to Evezich.

Accordingly, it may be appreciated that there continues to be a need for a new and improved fuel transfer container as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of fuel container apparatus now present in the prior art, the present invention provides a fuel transfer container wherein the same is arranged to direct fuel from a storage container to a receiving container or receptacle. As such, the general purpose of the present invention, which will be described subsequently in greater detail, is to provide a new and improved fuel transfer container which has all the advantages of the prior art fuel container apparatus and none of the disadvantages.

To attain this, the present invention provides a container including a fill cap, with a delivery conduit directed exteriorly of the fill cap, with a lower distal end within the container adjacent a floor of the container. The delivery conduit is arranged to include a delivery tube end member that includes a forward portion with a collar thereabout, including an outer conduit adjacent an inner central conduit, and the outer conduit is vented rearwardly of the collar for venting of fumes within a delivery fuel tank. A pressurizing squeeze bulb is in pneumatic communication interiorly of the container to effect pressurizing of fuel and fluid contained therewithin for direction through the delivery conduit, wherein the delivery conduit may further include a shut-off valve to cease fuel flow therethrough. A modification of the invention includes an extinguishing handle mounted to a top wall of the container below a transport handle in a complementary relationship, wherein the extinguishing handle includes a pneumatic cavity therewithin, including an extinguishing gas such as Halon gas for extinguishment of flames.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fuel transfer container which has all the advantages of the prior art fuel container apparatus and none of the disadvantages.

It is another object of the present invention to provide a new and improved fuel transfer container which may be easily and efficiently manufactured and marketed.

It is a further object of the present invention to provide a new and improved fuel transfer container which is of a durable and reliable construction.

An even further object of the present invention is to provide a new and improved fuel transfer container which is susceptible of a low cost of manufacture with regard to both materials and labor, and which accordingly is then susceptible of low prices of sale to the consuming public, thereby making such fuel transfer containers economically available to the buying public.

Still yet another object of the present invention is to provide a new and improved fuel transfer container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
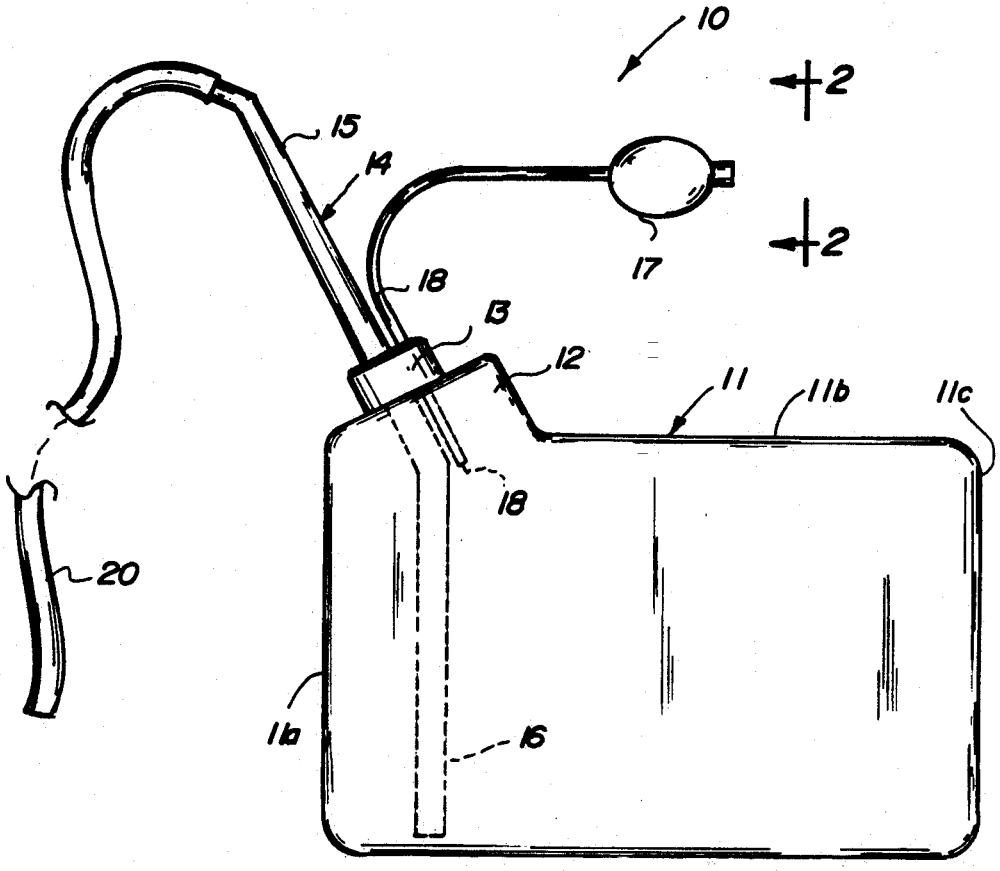
FIG. 1 is an orthographic side view of the instant invention.
Figure 2:
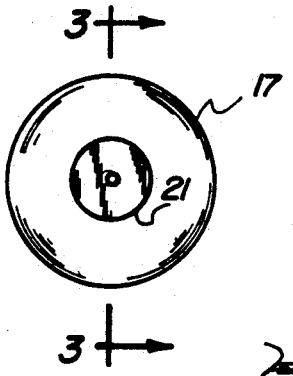
FIG. 2 is an orthographic rear view of the pressurizing bulb utilized by the invention.
Figure 3:
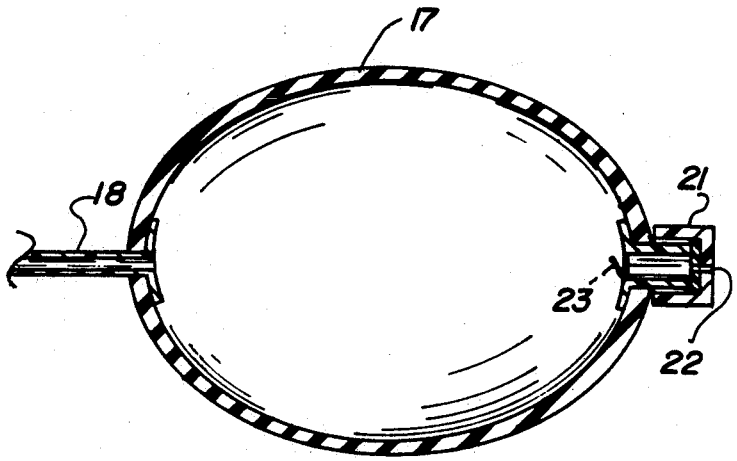
FIG. 3 is an orthographic view, taken along the lines 3—3 of FIG. 2 in the direction indicated by the arrows.
Figure 4:
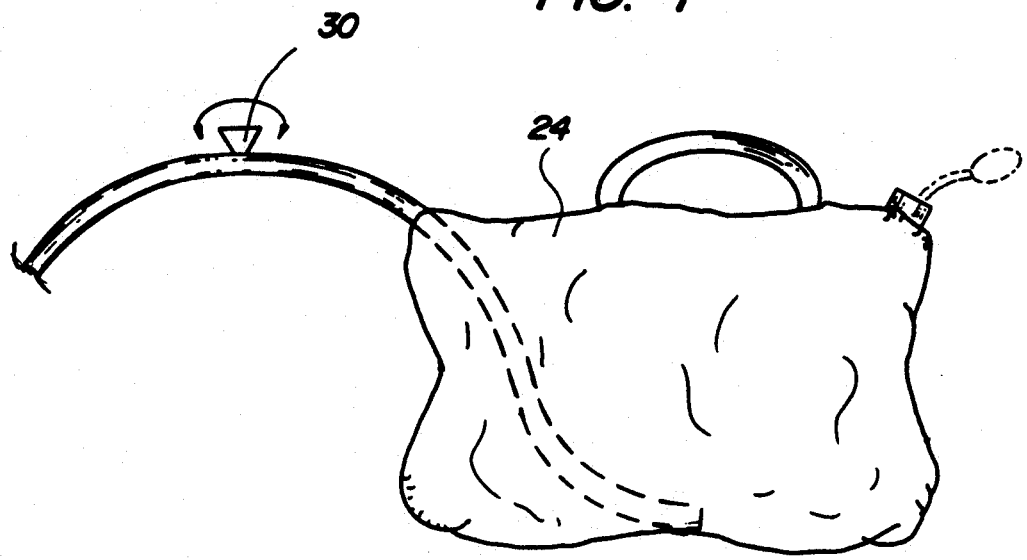
FIG. 4 is an orthographic view of a flexible storage container utilized by the invention.
Figure 5:
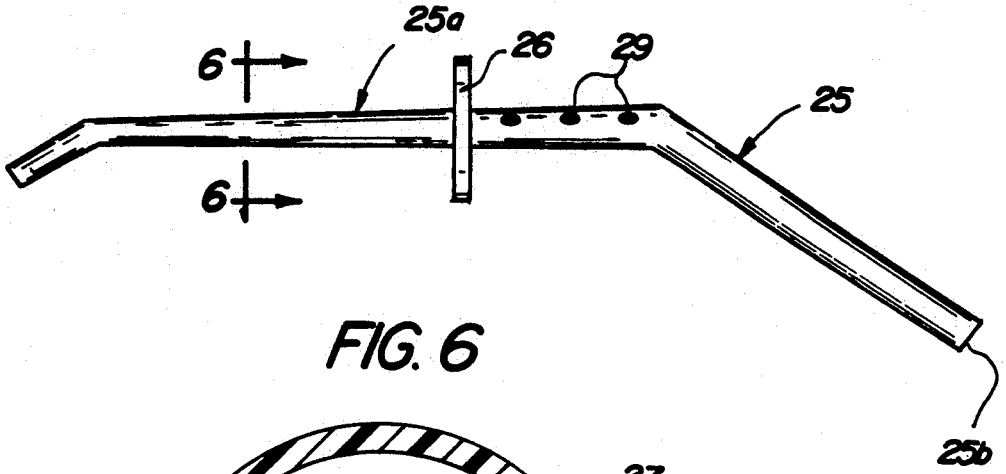
FIG. 5 is an orthographic side view of a delivery tube end member utilized for projection within a receiving receptacle.
Figure 6:
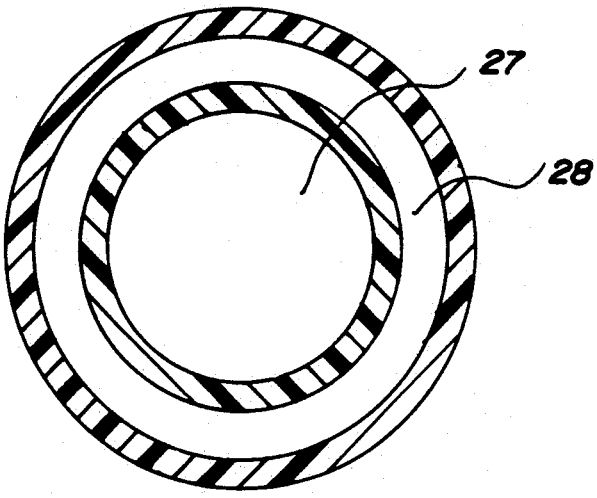
FIG. 6 is an orthographic view, taken along the lines 6—6 of FIG. 5 in the direction indicated by the arrows.

With reference now to the drawings, and in particular to FIGS. 1 to 14 thereof, a new and improved fuel transfer container embodying the principles and concepts of the present invention and generally designated by the reference numerals 10, 10*a*, and 10*b* will be described.

More specifically, the fuel transfer container 10 of the instant invention essentially comprises a rigid container 11, including a container front wall 11*a*, a container top wall 11*b*, and a container rear wall 11*c*, as well as a coextensive floor arranged below the top wall as illustrated. A cap member 13 mounted to the top wall adjacent the front wall 11*a* includes a rigid dispensing conduit 14 directed therethrough, that includes an outer dispensing conduit portion 15 and an inner dispensing conduit 16 that projects interiorly of the container adjacent the floor thereof. A pressurizing squeeze bulb 17 is mounted within the cap member 13, including a squeeze bulb conduit 18 positioned interiorly of the container adjacent the top wall, with the squeeze bulb including a vent cap portion 21 that includes a vent port 22 therethrough in communication with a vent flap valve 23, whereupon manual depressing of the squeeze bulb 17 effects closure of the flap valve 23 relative to the port 22, whereupon release of the squeeze bulb 17 permits refilling of the squeeze bulb 17 with air for a subsequent projection of such air through the squeeze bulb conduit 18. It should be noted that a flexible delivery tube 20, as illustrated in FIG. 1, may be mounted to the outer dispensing conduit 15 for ease of positioning of the conduit. Further, the flexible delivery tube 20 may be mounted to a delivery tube end member 25 of rigid construction relative to a free end 25*b* thereof. A collar abutment member 26 is mounted about the delivery tube end member 25 somewhat medially thereof to define a forward portion 25*a*. The delivery tube end member 25 includes a central conduit 27 directed therethrough (see FIG. 6), with a surrounding vent conduit 28 concentrically mounted relative to the central conduit 27 that terminates with vent ports 29 positioned through the vent conduit 28 adjacent the collar 26 between the collar 26 and the free end 25*b* for venting of combustible fumes from an associated delivery receptacle of any desired configuration (not shown).

Figure 7:
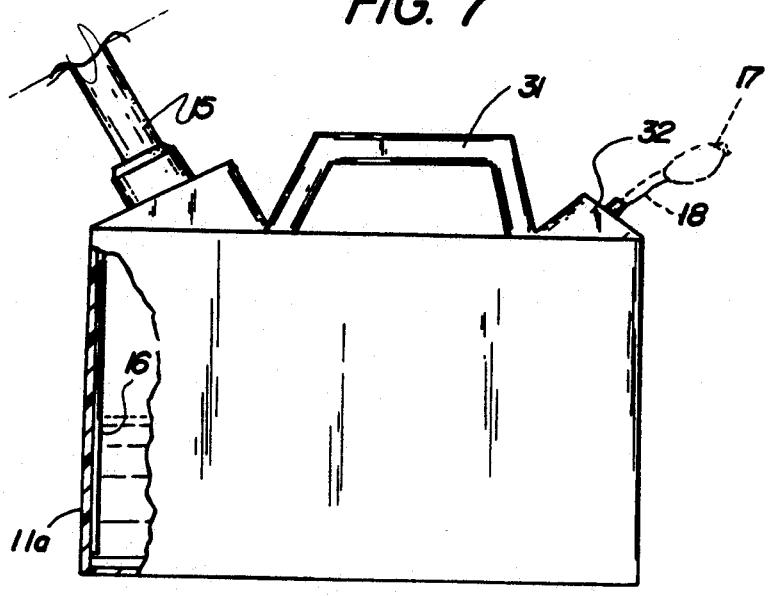
FIG. 7 is an orthographic side view, partially in section, of a modified container of the invention.
Figure 8:
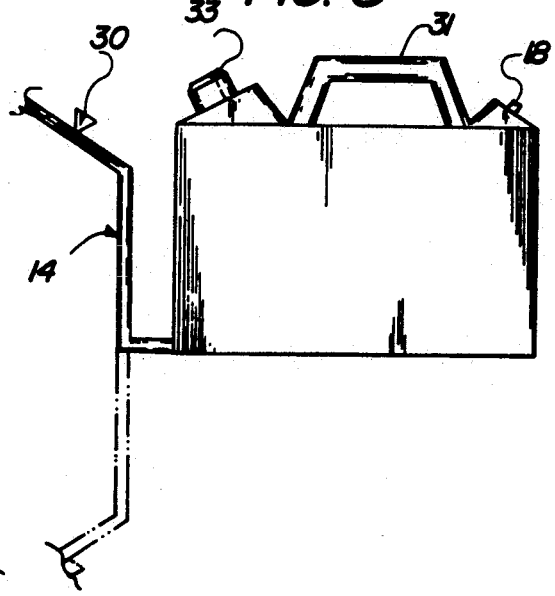
FIG. 8 is an orthographic side view of the container structure utilizing a repositioned delivery conduit.
Figure 9:
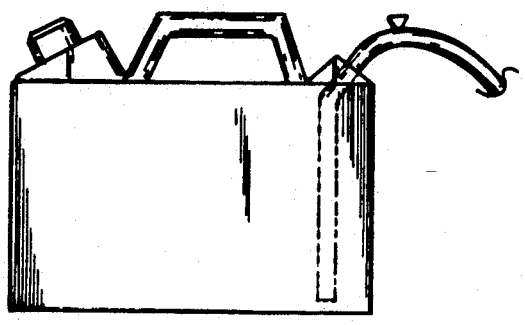
FIG. 9 is an orthographic side view of the container utilizing an elongate squeeze bulb conduit.

The FIG. 7 illustrates that the inner dispensing conduit 16 may be mounted integrally to the container to an interior portion of the front wall thereof, as well as mounted adjacent the floor through the front wall, in a manner as illustrated in FIG. 8. A shut-off valve 30 is optionally provided, whereupon pressurizing of the container 11 fluid flow through use of the shut-off valve may be ceased at any desired time in use.

Figure 10:
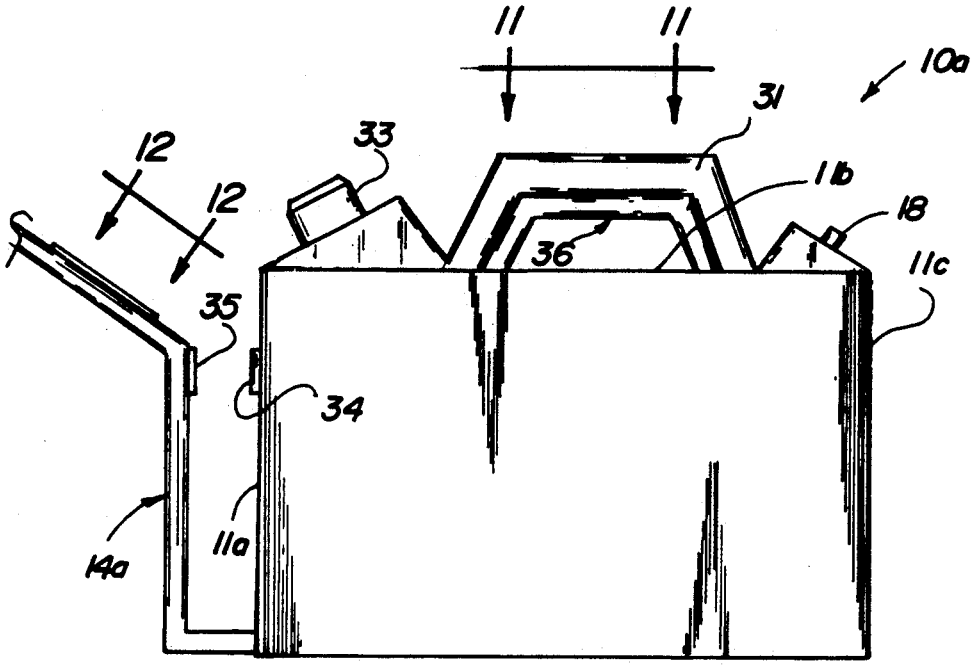
FIG. 10 is an orthographic side view of a further aspect of the invention.
Figure 11:
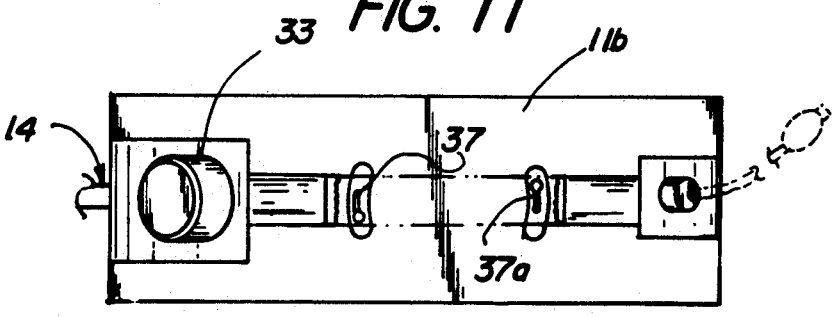
FIG. 11 is an orthographic view, taken along the lines 11—11 of FIG. 10 in the direction indicated by the arrows.
Figure 12:
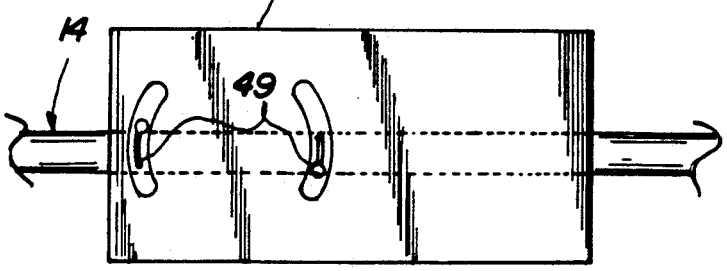
FIG. 12 is an enlarged view of the keyhole slot structure mounting the extinguishing handle of the invention.
Figure 13:
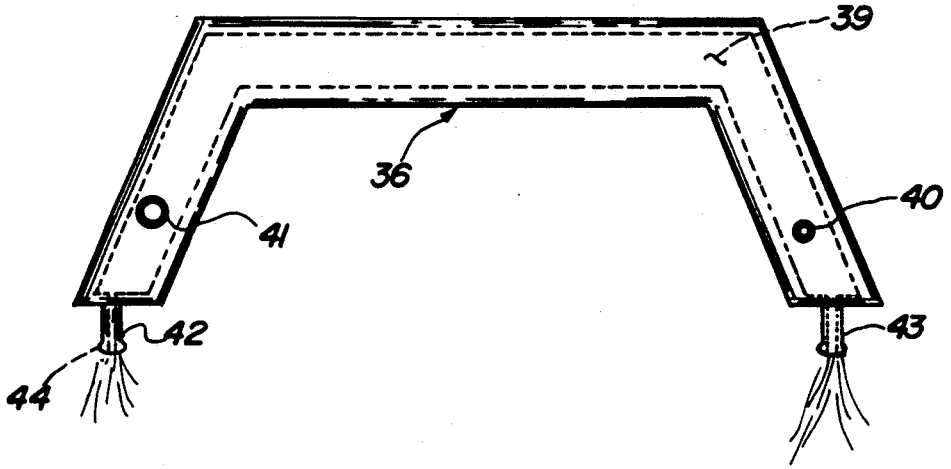
FIG. 13 is an orthographic side view of the extinguishing handle of the invention.

The apparatus 10*a*, as illustrated in the FIGS. 10–12, illustrates the use of a ferrous plate 34 mounted to the front wall 11*a* for cooperation with a ferromagnetic plate 35 mounted to a flexible dispensing conduit 14*a*. Further, a rigid handle loop 31 is mounted to the top wall between a fill cap 33 and the squeeze bulb conduit 18 directed into the top wall adjacent the rear wall 11*c*. In the embodiment of 10*a*, a fire extinguisher handle 36 is mounted in contiguous communication with a bottom surface of the handle loop 31 for selective securement to the top wall 11*a* to keyhole first and second arcuate slots 37 and 37*a*, as the handle 36 (see FIG. 13) utilizes a first and second lug 42 and 43 that is received within the respective first and second arcuate slots 37 and 37*a*. Alternatively, the handle may be removed relative to the top wall 11*a* and mounted to a dispensing conduit handle mounting plate 48 fixedly mounted to the handle 14 for ease of manipulation of the handle in use.

Figure 14:
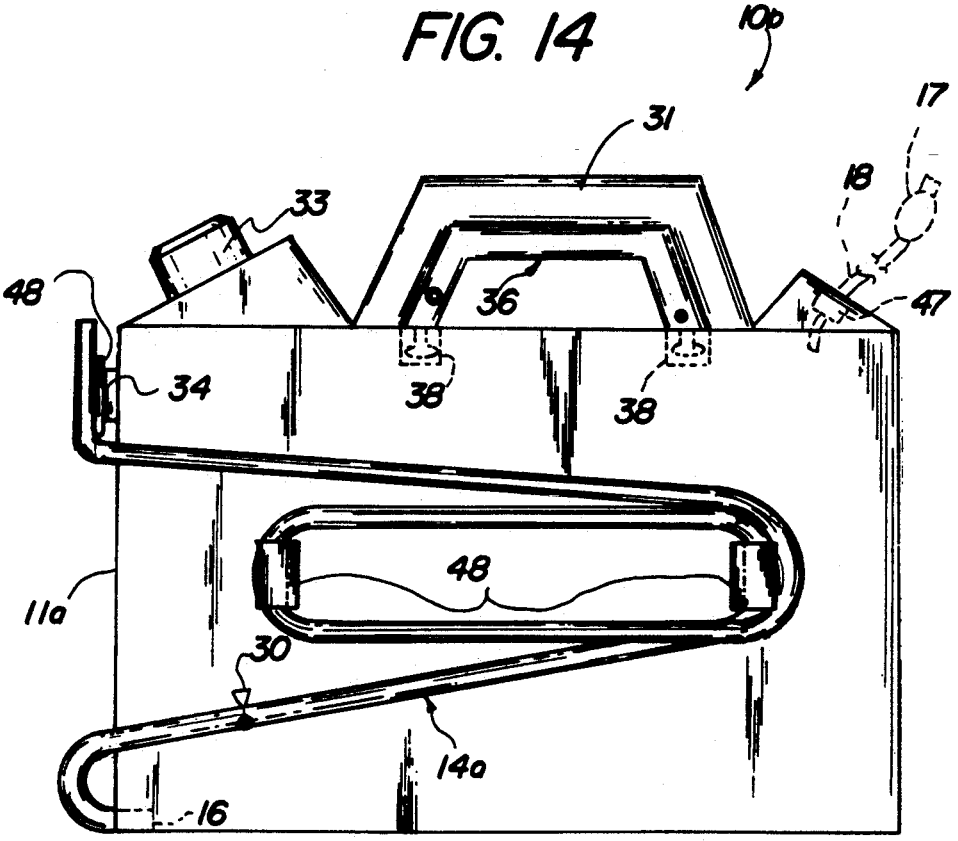
FIG. 14 is an orthographic side view of the invention in a further embodiment.

In the container 10*b*, as illustrated in FIG. 14, the ferromagnetic plate 35 may be formed as the dispensing conduit handle mounting plate 48 of a ferromagnetic construction for securement magnetically to the ferrous plate 34. The fire extinguishing handle 36 includes a pneumatic cavity 39, with a fill valve 40 directed through the handle for pressurizing the cavity 39, as well as a release button 41 positioned adjacent the first lug 42 that includes a release conduit 44 therethrough that releases a "Halon" gas through the release conduit 44. As illustrated, the first and second lugs 42 and 43 when mounted to the handle mounting plate 48 are selectively secured to mounting plate keyhole slots 49 for ease of manipulation of the flexible dispensing conduit 14*a*. The flexible dispensing conduit 14*a* may during periods of non-use be wound about spaced "L" shaped flanges 46 mounted to a side wall of the container 11, in a manner as illustrated in FIG. 14, wherein the organization may further include a check valve 47 in pneumatic communication with the squeeze bulb conduit 18 to prevent the flow of fluid through the check valve into the squeeze bulb 17 during pneumatic filling of the squeeze bulb 17 through the vent cap 21.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fuel transfer container, comprising, a rigid container including a container front wall, a container rear wall, a container top wall, and a container floor, and side walls with the dispensing container further including a flexible delivery conduit directed to the front wall adjacent the floor, and a fill cap mounted to the top wall adjacent the front wall, and squeeze bulb conduit directed through the fill cap, with the squeeze bulb conduit projecting into the container adjacent the top wall, and the squeeze bulb conduit including a flexible squeeze bulb mounted to the squeeze bulb conduit remote from the rear cap, the squeeze bulb including a vent cap, with the vent cap including a vent cap port, and a flap valve mounted within the squeeze bulb for effecting selective closure of air flow through the port into the squeeze bulb, and the flexible dispensing conduit includes a rigid delivery tube end member, the end member including a collar abutment positioned fixedly about the end member between a forward end of the end member and a rear end of the end member, and a conduit member and a rear end of the end member, and a central conduit directed coextensively throughout the end member, and a surrounding vent conduit extending from the forward end of the end member extending along the end member in surrounding relationship relative to the central conduit, including a plurality of vent ports directed through the vent conduit adjacent the collar abutment between the collar abutment and the rear end.

* * * * *